US009491534B2

(12) United States Patent
Birger et al.

(10) Patent No.: US 9,491,534 B2
(45) Date of Patent: Nov. 8, 2016

(54) MONAURAL WIRELESS HEADSET

(71) Applicant: GN Audio A/S, Ballerup (DK)

(72) Inventors: Johan Birger, Ballerup (DK); Morten Urup, Ballerup (DK); Michael Sørensen, Ballerup (DK)

(73) Assignee: GN Audio A/S (DK)

( * ) Notice: Subject to any disclaimer, the term of this patent is extended or adjusted under 35 U.S.C. 154(b) by 0 days.

(21) Appl. No.: 14/724,289

(22) Filed: May 28, 2015

(65) Prior Publication Data

US 2015/0350762 A1 Dec. 3, 2015

(30) Foreign Application Priority Data

Jun. 3, 2014 (EP) ..... 14170947

(51) Int. Cl.
*H04R 1/10* (2006.01)

(52) U.S. Cl.
CPC ..... *H04R 1/1025* (2013.01); *H04R 1/1016* (2013.01); *H04R 1/1066* (2013.01); *H04R 1/1075* (2013.01); *H04R 2420/07* (2013.01)

(58) Field of Classification Search
CPC ..... H04R 1/1025; H04R 2420/07
USPC ..... 381/74, 187, 309, 363, 375, 318, 320, 381/322, 324, 328, 374, 380, 430; 455/569.1, 575.2; 340/573.1
See application file for complete search history.

(56) References Cited

U.S. PATENT DOCUMENTS 4,917,504 A * 4/1990 Scott ..... H04M 1/05 381/330
6,819,762 B2 * 11/2004 Jones ..... H04M 1/05 379/430

(Continued)

FOREIGN PATENT DOCUMENTS

EP 2330829 6/2011

OTHER PUBLICATIONS

Extended European Search Report dated Jan. 5, 2015 for European patent application No. 14170947.7.

*Primary Examiner* — Gerald Gauthier
(74) *Attorney, Agent, or Firm* — Altera Law Group, LLC

(57) ABSTRACT

The present invention relates to a monaural wireless headset (20) that may e.g. be connected to a mobile phone by means of a Bluetooth connection.

The present invention provides a monaural wireless headset (20) comprising a housing (21) with a main body (22) and a microphone boom (23), a microphone (27), a wireless transceiver (28), a speaker driver (39) and a rechargeable battery (29). The monaural wireless headset (20) is adapted to be arranged at an ear (1) of a user in a wearing position wherein at least a portion of the main body (22) resides on the inwards side of the crest (7) of the ear's antitragus (6) and wherein the microphone boom (23) at least partly extends outside the ear's pinna (1) towards the user's mouth. The microphone (27) is arranged in the microphone boom (23) and is adapted to receive a voice signal from the user and provide a microphone signal to the wireless transceiver (28) in dependence on the voice signal. The wireless transceiver (28) is adapted to transmit a wireless output signal in dependence on the microphone signal. Furthermore, the wireless transceiver (28) is adapted to receive a wireless input signal and provide an audio output signal to the speaker driver (39) in dependence on the wireless input signal. The speaker driver (39) is arranged and adapted to transmit a sound signal into the ear (1) in dependence on the audio output signal, and the rechargeable battery (29) is adapted to provide electric power to the wireless transceiver (28) and the speaker driver (39).

The monaural wireless headset (20) is characterized in that the speaker driver (39) and the rechargeable battery (29) are arranged in the main body (22) in such a way that the speaker driver (39) and at least a portion of the rechargeable battery (29) reside on the inwards side of the crest (7) of the antitragus (6) when the monaural wireless headset (20) is in the wearing position.

This may provide a monaural wireless headset (20) that allows a comfortable wearing and a secure holding of the headset (20) when in use.

20 Claims, 7 Drawing Sheets

(56) References Cited

U.S. PATENT DOCUMENTS 7,031,485 B2 * 4/2006 Webber ..... H04R 1/105 381/328
7,149,552 B2 * 12/2006 Lair ..... H04M 1/6066 455/518
7,379,557 B2 * 5/2008 Chou ..... H04M 1/05 381/370
7,502,484 B2 * 3/2009 Ngia ..... G10L 15/02 381/312
7,734,055 B2 * 6/2010 Chiloyan ..... H04M 1/6066 381/109
7,974,664 B2 * 7/2011 Liu ..... H04R 1/1066 379/430
7,983,433 B2 * 7/2011 Nemirovski ..... H04R 1/1016 381/151
7,986,803 B1 * 7/2011 Dekalb ..... H04R 1/1066 381/328
8,059,845 B2 * 11/2011 Bryant ..... H04R 1/105 181/130
8,111,861 B2 * 2/2012 Lowry ..... H04R 1/1016 181/135
8,184,841 B2 * 5/2012 Wurfel ..... H04R 25/656 381/328
8,218,799 B2 * 7/2012 Murphy ..... H04R 1/1016 381/309
8,401,218 B2 * 3/2013 Son ..... H04R 1/1058 181/129
8,605,927 B2 * 12/2013 Fretz ..... H04R 25/60 381/312
8,611,578 B2 * 12/2013 Kim ..... H02J 7/0044 379/420.01
8,737,669 B2 * 5/2014 Monahan ..... H04R 1/1016 381/325
8,805,452 B2 * 8/2014 Lee ..... H04R 1/10 381/380
9,380,370 B2 * 6/2016 Lowry ..... H04R 1/1016
2002/0131585 A1 9/2002 Jones
2003/0157972 A1 8/2003 Bae
2004/0257233 A1 * 12/2004 Proebsting ..... G08B 23/00 340/573.1
2008/0273735 A1 * 11/2008 Burson ..... H04R 1/083 381/363
2011/0135135 A1 * 6/2011 Hofman ..... H04M 1/05 381/375
2011/0170703 A1 * 7/2011 Palma ..... H04R 1/1041 381/74
2011/0244927 A1 * 10/2011 Kari ..... H04B 1/385 455/569.1
2012/0039500 A1 * 2/2012 Silvestri ..... H04R 1/1016 381/380
2012/0039501 A1 * 2/2012 Silvestri ..... H04R 1/1075 381/380
2012/0308069 A1 * 12/2012 Stott ..... H04R 1/105 381/380
2014/0153768 A1 * 6/2014 Hagen ..... H04R 1/1008 381/380
2015/0350762 A1 * 12/2015 Birger ..... H04R 1/1016 381/74

* cited by examiner

MONAURAL WIRELESS HEADSET

TECHNICAL FIELD

The present invention relates to a monaural wireless headset.

BACKGROUND ART

In the prior art, monaural wireless headsets are known that are connectable to a mobile phone by means of a Bluetooth connection. Known monaural wireless headsets typically comprise a housing with a main body containing a rechargeable battery, one or more microphones and a major portion of the headset electronics. A speaker driver is typically mounted in a housing portion with a shape enabling it to extend into the concha of the user's ear when worn, while the main body is generally adapted to be arranged outside the concha. In some headsets, one or more of the microphones are arranged in a microphone boom extending from the main body towards the user's mouth.

Various types of wearing means are known for holding a headset in the intended position during use. Some known wearing means comprise an elastic bracket intended to partly surround the outer ear or pinna of the user. While such wearing means may enable a secure holding of a headset, they may be less comfortable to wear. Other wearing means comprise an elastic member intended to press against an inner wall of the concha and/or an elastic plug intended to fit into the ear canal. Such wearing means typically provide better wearing comfort, but may not provide a secure holding of a monaural wireless headset.

DISCLOSURE OF INVENTION

It is an object of the present invention to provide a monaural wireless headset that allows a comfortable wearing and a secure holding of the headset when in use. This and other objects of the invention are achieved by the invention defined in the independent claims and further explained in the following description. Further objects of the invention are achieved by embodiments defined in the dependent claims and in the detailed description of the invention.

The terms "voice signal", "sound" and "sound signal" refer to signals propagating in media by means of pressure or particle density variations. The term "audio signal" refers to a signal directly or indirectly derived from a sound signal, to a signal that is directly or indirectly transformed into a sound signal and/or to a signal provided for such a transformation. An audio signal may itself be a sound signal. An audio signal may constitute or comprise an arbitrary representation of a sound signal, such as e.g. an electric signal, an optical signal, a radio frequency signal, an inductive signal, a capacitive signal or an ultrasound signal, and the sound signal may be represented or encoded e.g. as an analog signal, a digital signal, a modulated signal etc.

Within this document, the singular forms "a", "an", and "the" are intended to include the plural forms as well (i.e. to have the meaning "at least one"), unless expressly stated otherwise. Likewise, the term "any" is intended to include both the singular and the plural form, unless expressly stated otherwise. Correspondingly, the terms "has", "includes", "comprises", "having", "including" and "comprising" specify the presence of respective features, operations, elements and/or components, but do not preclude the presence or addition of further entities. The term "and/or" generally includes any possible combination of one or more of the associated items. Steps or operations of any method disclosed herein need not be performed in the order disclosed, unless this is expressly stated.

Furthermore, when an element or entity is referred to as being "connected" or "coupled" to another element or entity, this includes direct connection (or coupling) as well as connection (or coupling) via intervening elements or entities, unless expressly stated otherwise. Also, unless expressly stated otherwise, when a signal is referred to as being "provided" or "conveyed" by a first entity to a second entity, this includes directly or indirectly transmitting the signal in its original form as well as any direct or indirect transmission that modifies the original signal and/or converts the signal into another domain and/or representation before it arrives at the second entity, provided that the information comprised by the signal received by the second entity is sufficient for the second entity to perform the specified actions with respect to the signal.

Ordinal attributes like "first", "second", "primary", "secondary", "main" and "auxiliary" are intended to allow distinguishing between different entities, and should not be construed as implying any order, hierarchy, dependency or precedency unless expressly stated otherwise.

BRIEF DESCRIPTION OF THE DRAWINGS

The invention will be explained in more detail below in connection with preferred embodiments and with reference to the drawings in which.

The figures are schematic and simplified for clarity, and they just show details essential to understanding the invention, while other details may be left out. Where practical, like reference numerals or literal identifiers are used for identical or corresponding parts.

MODE(S) FOR CARRYING OUT THE INVENTION

Figure 1:
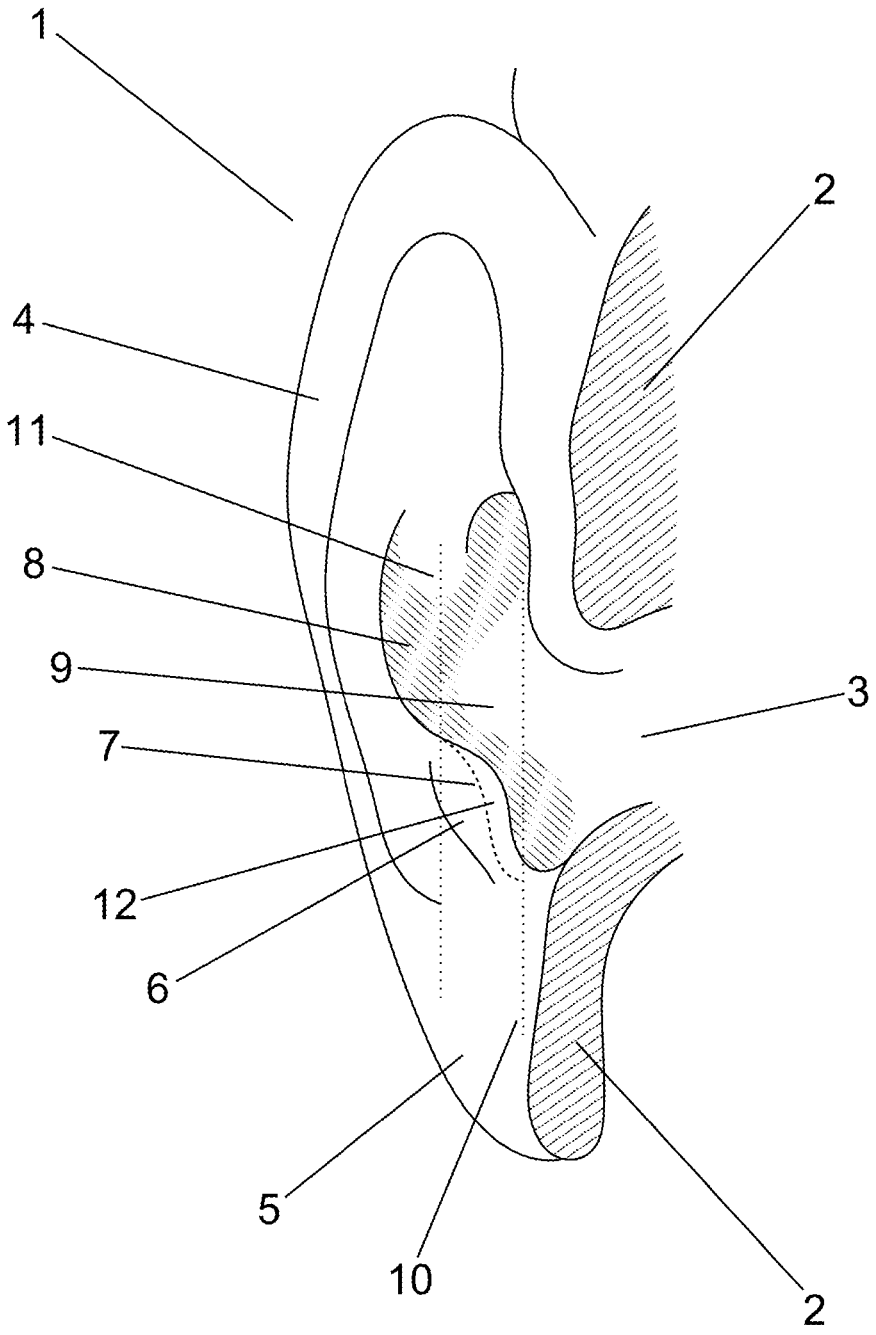
FIG. 1 shows features of a human ear.

FIG. 1 shows a frontal section of a typical pinna 1 of a human. The section plane intersects tissue and cartilaginous parts of the pinna 1 as indicated by the shaded areas 2 as well as the ear canal of which only the entrance 3 is shown. The helix 4 and the earlobe 5 together form an outer rim of the pinna 1. Above the earlobe 5, the antitragus 6 forms an upwardly and forwardly directed ridge, the crest of which is indicated by the dashed line 7. The shaded area 8 indicates portions of the concha 9 that are typically obscured by other features of the pinna 1, such as e.g. the antitragus 6, when the ear 1 is viewed from the side, i.e. in a lateral view. The two vertical dotted lines 10, 11 indicate respectively the front end and the rear end of the antitragus crest 7. The antitragus crest 7 outwardly delimits an inwardly inclined surface area 12 of the antitragus 6. Each line 10/11 may be used to define a center of gravity line. In the preferred embodiment the outer line 11 at the antitragus crest, is preferred for balance analysis.

Within the present description and the claims, directions and orientations are given with FIG. 1 as reference, unless otherwise stated. Where a direction or an orientation concerns a headset or a feature thereof, the headset is presumed arranged at the ear 1 in its intended wearing position with the ear 1 oriented as shown in FIG. 1. Unless otherwise stated, the terms "inwards" (or "inner") and "outwards" (or "outer") indicate respectively a direction towards the sagittal plane, i.e. to the right in FIG. 1, and a direction away from the sagittal plane, i.e. to the left in FIG. 1.

FIG. 2-6 show features of two different monaural wireless headsets, which, however, have many features in common. They both illustrate how a monaural wireless headset with an improved wearing comfort may be provided without compromising secure holding or other relevant specifications, such as e.g. the sound quality, the ease of use, the operating time (battery charging interval) and/or the possibility to manufacture large quantities of headsets without having to customize or fit the headsets individually for each user at the factory.

Figure 2:
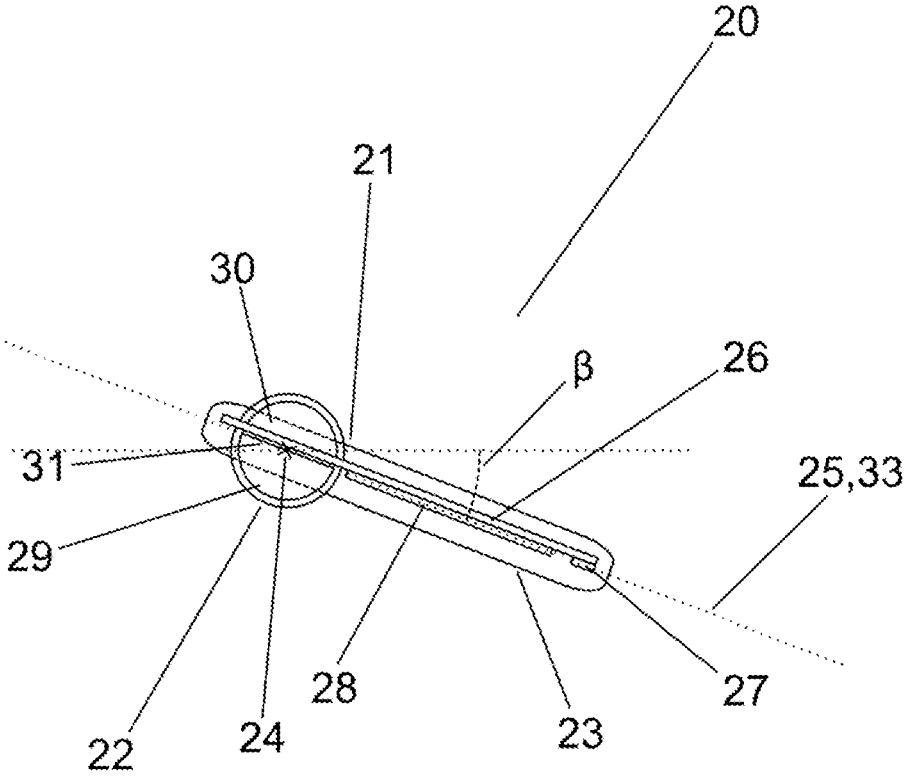
FIG. 2 shows a first embodiment of a monaural wireless headset according to the invention.

FIG. 2 shows a lateral view of a monaural wireless headset 20 with an outwards facing wall 34 (see FIG. 3) of the housing 21 removed. The monaural wireless headset 20 is shown as viewed from the side facing outwards when the headset 20 is worn and with an orientation substantially corresponding to the orientation in an intended wearing position (see FIG. 4) at the user's right-hand ear 1. The housing 21 comprises a main body 22 and a microphone boom 23. The main body 22 is substantially cylindrical with a substantially laterally oriented cylinder axis 24, and the microphone boom 23 extends across the axially outer end of the main body 22 forwards towards the user's mouth along a boom axis 25 with an angle $\alpha$ (see FIG. 3*b*) with respect to the cylinder axis 24 of approximately 85° and with a downwards angle $\beta$ of about 15-25°. As can be seen from FIGS. 2 and 3, the general design of the housing 21 is based primarily on two ideal design elements, namely a cylinder defining the substantial shape of the main body 22 and a rod defining the substantial shape of the microphone boom 23. The ideal design elements 22, 23 intersect and thus share a common volume 30 within the housing 21. Boundaries of the common volume 30 are indicated by dashed lines in FIGS. 2 and 3*c*. A circuit board 26 is arranged within the microphone boom 23 and extends through a length portion of the microphone boom 23 and the common volume 30 of the ideal design elements 22, 23. A microphone 27 is arranged near the mouth end or front end of the circuit board 26 within the microphone boom 23. A wireless transceiver 28 is arranged at the circuit board 26 along a major portion thereof. The main body 22 comprises a cylindrically wound lithium-ion rechargeable battery 29. The rechargeable battery 29 has a cylindrical section with a cylinder axis substantially equal to the cylinder axis 24 of the main body 22. The rechargeable battery 29 further has an outer fin-shaped electrode 31 at its axially outer end and an inner fin-shaped electrode 32 (see FIG. 3*c*) at its axially inner end. The outer electrode 31 extends mainly in a device-median plane 33 parallel to the cylinder axis 24 and parallel to the boom axis 25. The generally circular cross section of the axially inner portion of the main body 22 allows the user to easily rotate the housing 21 about the cylinder axis 24 and thus adjust the downwards angle $\beta$ of the microphone boom 23 to fit personal preferences without causing any discomfort.

FIGS. 3*a*, 3*b* and 3*c* show orthogonal views of the monaural wireless headset 20. FIG. 3*a* shows the monaural wireless headset 20 from the same side as in FIG. 2, however with the outwards facing wall 34 of the housing 21 in place and with the boom axis 25, and thus also the device-median plane 33, oriented horizontally. The outwards facing wall 34 has a microphone inlet 35 near its mouth end that acoustically connects the environment with a sound inlet of the microphone 27 such that a voice signal from the user may reach the microphone 27 when the monaural wireless headset 20 is worn in the wearing position. The main body 22 has a diameter—and thus a height $H_b$—of about 15 mm, while the microphone boom 23 has a height $H_m$ of about 7 mm. The microphone boom 23 has a total length L of about 58 mm and extends forwards from the main body 22 by a boom length $L_m$ of about 38 mm.

FIG. 3*b* shows a bottom view of the monaural wireless headset 20 perpendicular to the device-median plane 33. Near its axially inner end, the cylinder surface of the main body 22 has an annular groove 36 for detachably receiving a corresponding rim of a resilient earbud 37. FIG. 3*b* shows a section of the earbud 37 in the device-median plane 33. The earbud 37 has a channel 38 that acoustically connects a sound outlet of a speaker driver 39 (see FIG. 3*c*) with the environment such that a sound signal provided by the speaker driver 39 may reach the user's ear canal 3 when the monaural wireless headset 20 is worn in the wearing position. The circular cross section of the axially inner portion of the main body 22 and the annular groove 36 allow the user to manually rotate the earbud 37 about the cylinder axis 24 of the main body 22 and thus adjust the fit. The earbud 37 may further comprise an elastic support member (not shown) extending approximately perpendicularly to the battery axis 24 opposite the sound channel 38 and having a shape, like e.g. a hook, a ring or a fin, and an elasticity allowing it to apply a pressure onto a portion of the concha 9, preferably onto a rear portion of the concha 9, such as e.g. a portion within the shaded area 8 in FIG. 1, in order to support or maintain the monaural wireless headset 20 in the wearing position. The main body 22 has a width $W_b$ of about 18 mm, while the microphone boom 23 has a width $W_m$ of about 10 mm. At the main body 22, the inwards facing surface of the microphone boom 23 has an outwards offset $W_o$ of about 12 mm from the axially inner end of the main body 22, such that the monaural wireless headset 20—without the earbud 37—has a total width W of about 22 mm.

FIG. 3*c* shows a front section view of the monaural wireless headset 20 along the boom axis 25. Dashed lines indicate boundaries of the common volume 30 shared by the ideal design elements 22, 23 of the housing 21. The section plane intersects the main body 22, the microphone boom 23, the circuit board 26, the rechargeable battery 29, the common volume 30, the outer electrode 31, the inner electrode 32 and the speaker driver 39. The speaker driver 39 is arranged coaxially with the main body 22 and thus with the rechargeable battery 29. The inner electrode 32 extends mainly in a plane perpendicular to the cylinder axis 24, which allows the cylindrical section of the rechargeable battery 29 and the speaker driver 39 to be arranged with a minimum distance $W_s$ to each other of about 1 mm. The cylindrical section of the rechargeable battery 29 has a width, i.e. an axial length, $W_r$ of about 12 mm, and the speaker driver 39 has a width $W_d$ of about 3 mm. Thus, the axially inner end or surface area of the rechargeable battery 29 is located about 4 mm outwards from the axially inner end or surface area of the speaker driver 39. A length section of the circuit board 26 extending across the axially outer end of the rechargeable battery 29 has a width $W_c$ of about 3 mm. One or more length sections of the circuit board 26 located further towards the mouth end of the microphone boom 23 have a larger width of about 6-8 mm. The latter is possible because the rechargeable battery 29 does not limit the available space for such sections.

Figure 3:
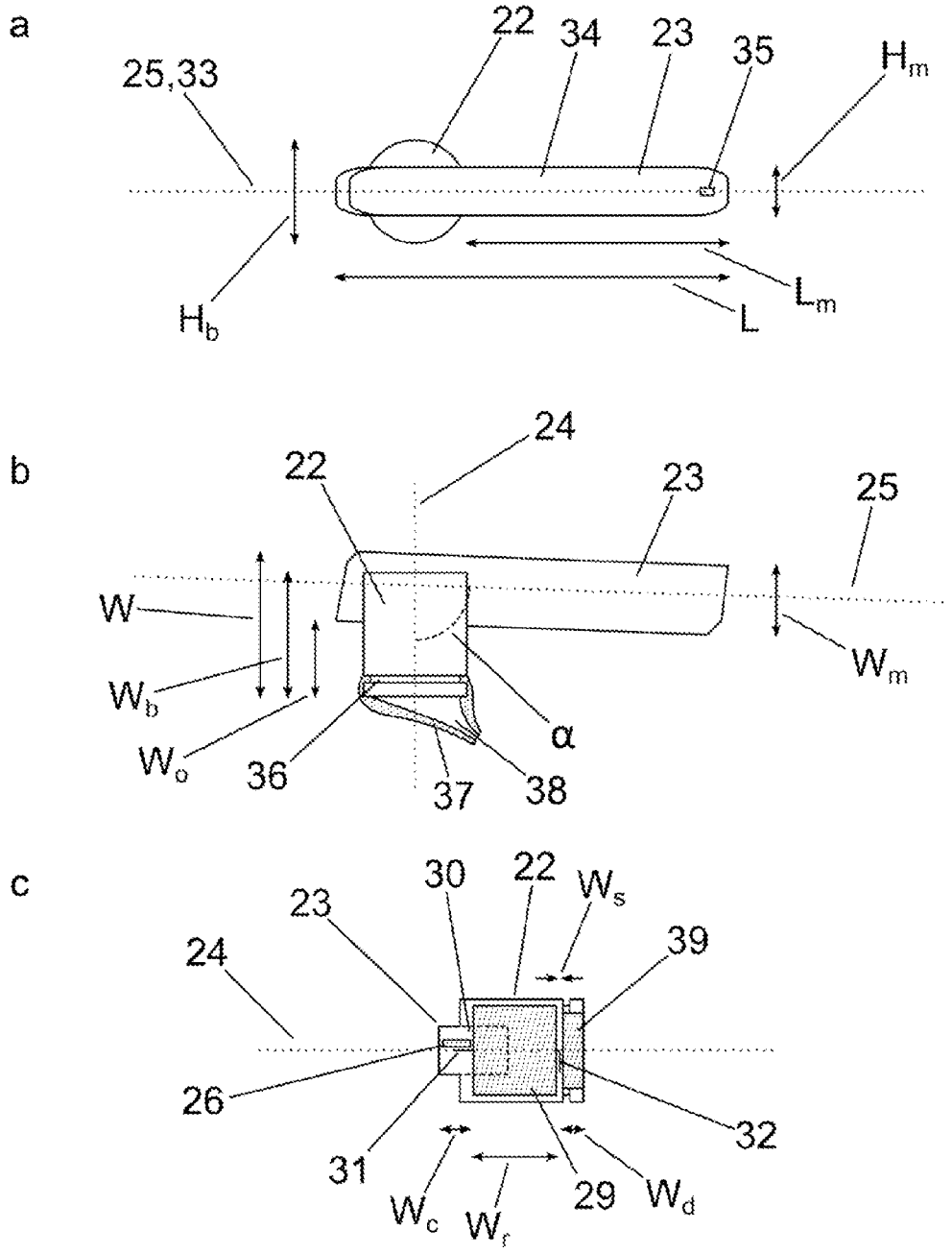
FIG. 3 shows different views of the monaural wireless headset of FIG. 2.
Figure 4:
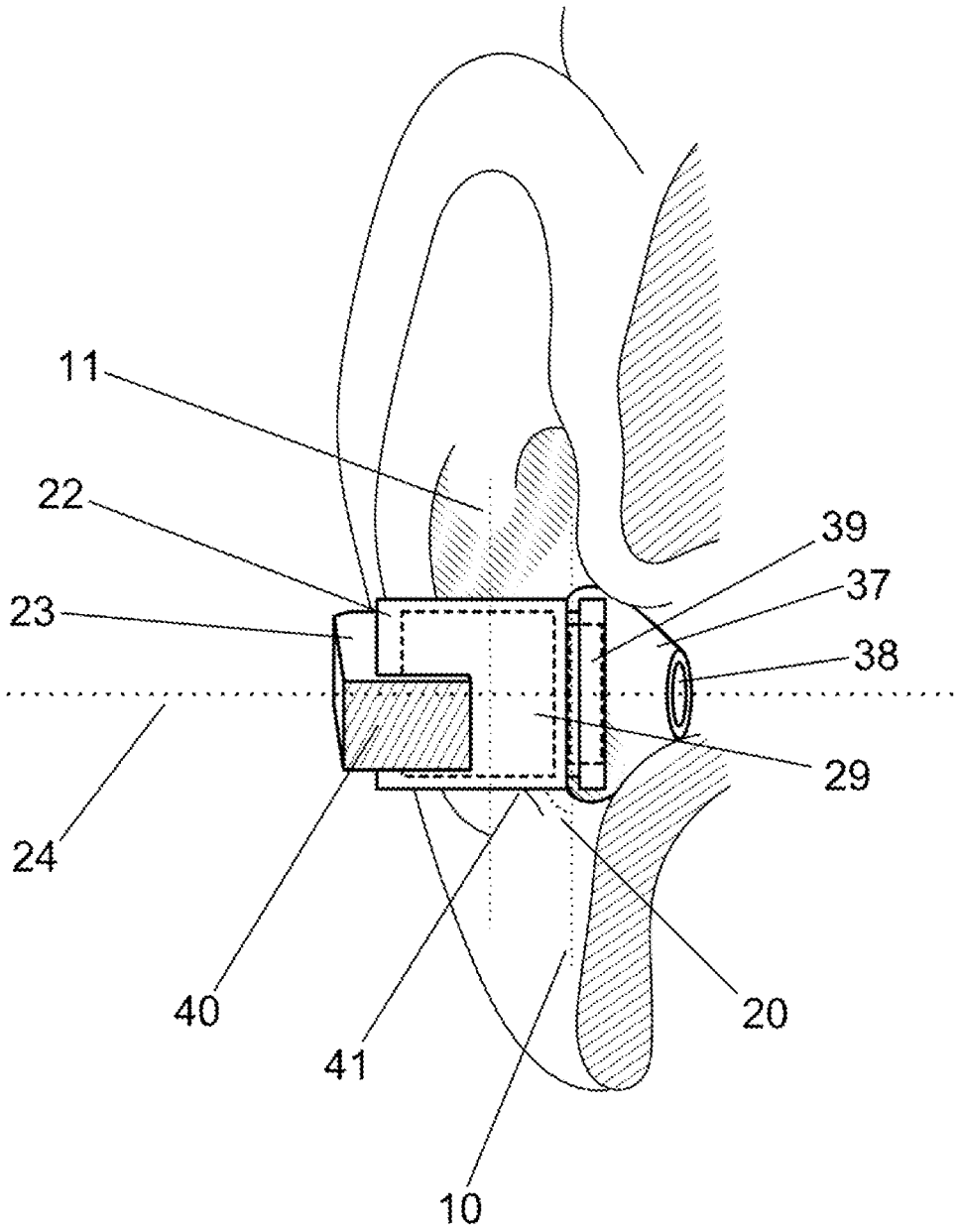
FIG. 4 shows a wearing position of the monaural wireless headset of FIGS. 2 and 3.

FIG. 4 shows a frontal section of the pinna 1 of FIG. 1 with the monaural wireless headset 20 of FIGS. 2 and 3 arranged in its intended wearing position. The section plane is the same as in FIG. 1. Since the shape of the pinna 1 is individual for each user, the actual wearing position may deviate from the shown intended wearing position. The main body 22 lies entirely behind the section plane with its cylinder axis 24 oriented horizontally. The outlines of the rechargeable battery 29 and the speaker driver 39 are indicated by respective dashed rectangles. The section plane intersects the microphone boom 23 where it protrudes forwards towards the user's mouth as indicated by the shaded area 40. The microphone boom 23 extends forwards with a downwards angle β, and—as may be deducted from the figure—its outwards offset $W_o$ allows it to extend past the tragus (not shown) and thus extend outside the pinna 1 without causing discomfort to the user. The earbud 37 is shown as a transparent body. Its channel 38 leads sound output from the speaker driver 39 forwards and inwards into the opening 3 of the ear canal. A support surface 41 of the main body 22 abuts a portion of the antitragus 6, in particular a portion of the crest 7, when the monaural wireless headset 20 is in the wearing position. The support surface 41 extends mainly across lower and rear portions of the cylinder surface near the axially inner end of the main body 22. The exact position and extension of the support surface 41 for a particular user depends on the actual shape of the user's pinna 1 and on the user's choice of downwards angle β of the microphone boom 23.

The general design of the monaural wireless headset 20, the dimensions of the housing 21 as well as the shown arrangement of the rechargeable battery 29 and the speaker driver 39 within the main body 22 allows most adult users to arrange the monaural wireless headset 20 such in their ear 1 that the speaker driver 39 and a portion of the rechargeable battery 29 reside on the inside of the crest 7 of the antitragus 6, i.e. further towards the sagittal plane than the crest 7. Since the rechargeable battery 29 and the speaker driver 39 are relatively heavy components of the monaural wireless headset 20, the shown headset configuration and wearing position provide for an improved balance of the housing 21 such that for most adult users, the earbud 37 and the support surface 41 will suffice to securely hold the monaural wireless headset 20 in place during use. Furthermore, the resilient earbud 37 as well as the smooth support surface 41 make the monaural wireless headset 20 comfortable to wear. In the preferred embodiment the center of gravity of the headset should be inside of the center of gravity line 10 or preferably 11. In practice it is possible for the headset to be located A. laterally on the inside of the antitragus crest,
B. within headset main body,
C. longitudinally about 2 mm from the foremost portion of the main body, (towards the user's,
D. wherein at least 50% of the mass/weight is located laterally at the antitragus crests or less than 5 mm outside of the antitragus crest,
E. wherein at least 50% of the mass/weight is located laterally on the inside of the antitragus crest,
F. wherein at least 50% of the mass/weight is located within the main body.

Other configurations of weight distribution are possible with the primary goal of insuring that the headset has a tendency to stay in the ear rather than fall out. By locating the center of gravity deeper within the user's ear, this goal can be achieved. The location of the battery, often being placed in the headset in a "convenient" location, should be placed to improve the balance of the headset toward the user's ear instead of away from it. In general therefore, the turning moment or the tendency of the headset to fall in one direction or other along a vertical plane, is toward the inside of the user's ear, so that the headset tends to stay in the ear, rather than fall out. The center of gravity of the headset therefore, should be close to the antitragus crest, but does not have to be inside of it, because the geometry of the ear is not as simple as a fixed balance point.

In order to further secure the monaural wireless headset 20 in the wearing position, for instance during physical exercise, the monaural wireless headset 20 may further comprise a detachable ear hook (not shown) having an annular fastening means adapted to surround a cylindrical section of the main body 22 and dimensioned to provide a frictional fit between the ear hook and the main body 22, such that the ear hook is rotatable about the cylinder axis 24 of the main body 22, such that a user can attach the ear hook to the monaural wireless headset 20 by sliding it onto the cylinder surface of the main body 22 from the axially inner end of the main body 22 and such that the user can detach it by the corresponding reversed action. The annular fastening means may preferably be elastic and have a radially inner surface that has a substantially circular cylindrical section and has e.g. three, four or five axially oriented and evenly distributed ridges, such that when the ear hook is attached to the main body 22, the ridges abut the main body 22 and cause a predefined elastic deformation of the annular fastening means, which thereby exerts a radially inwards directed force with a predefined magnitude on the cylinder surface of the main body 22. The ridges thus provide an improved frictional fit.

Figure 5:
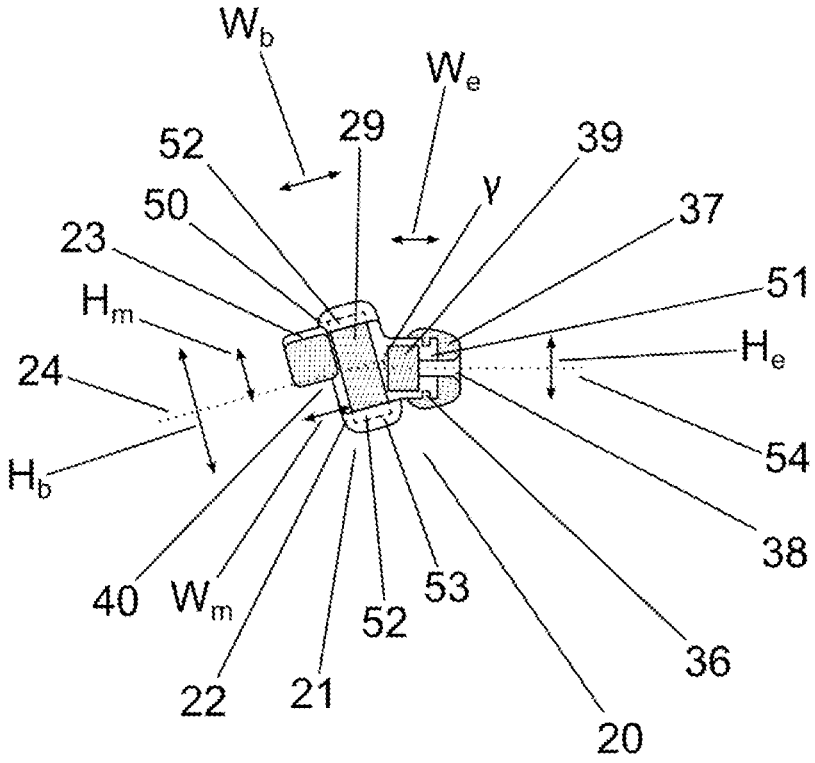
FIG. 5 shows a second embodiment of a monaural wireless headset according to the invention.

FIG. 5 shows a front section of a monaural wireless headset 20 with a housing 21 comprising a main body 22 and a microphone boom 23. The main body 22 has a battery compartment 50 mainly comprising a rechargeable battery 29 and a speaker compartment 51 mainly comprising a speaker driver 39. The rechargeable battery 29 is a button-cell lithium-ion battery with a generally circular cross section and a corresponding battery axis 24. The battery compartment 50 has a generally circular cross section and is arranged coaxially with the battery axis 24. The battery axis 24 lies behind the section plane. In the view shown, portions 52 of the battery compartment 50 thus obscure portions of the rechargeable battery 29, the outline of which is indicated by the dashed rectangle 53. The battery compartment 50 has a diameter or height $H_b$ of about 17 mm and a width $W_b$ along the battery axis 24 of about 8 mm.

Similarly, the speaker driver 39 and the speaker compartment 51 have generally circular cross sections and are arranged coaxially with a common speaker axis 54 that lies horizontally in the section plane. Near its axially inner end, the speaker compartment 51 has an annular groove 36 for detachably receiving a corresponding rim of a resilient earbud 37. The earbud 37 has a channel 38 that acoustically connects a sound outlet of the speaker driver 39 with the environment such that a sound signal provided by the speaker driver 39 may reach the user's ear canal 3 when the monaural wireless headset 20 is worn in a wearing position (see FIG. 6). The circular cross section of the axially inner portion of the speaker compartment 50 and the annular groove 36 allow the user to manually rotate the earbud 37 about the speaker axis 54 to adjust the fit of asymmetric earbuds 37. The speaker compartment 51 has a diameter or height $H_e$ of about 8 mm and a width $W_e$ along the speaker axis 54 of about 8 mm allowing it to be at least partly inserted into the ear canal 3.

The battery axis 24 is inclined by an angle γ of about 20° with respect to the speaker axis 54, such that the battery compartment 50 appears to be tilted outwards by the same angle γ. The microphone boom 23 is connected to the main body 22 at the axially outer portion of the battery compartment 50 and extends forwards with a downwards angle β (similarly as shown in FIG. 2). The section plane intersects the microphone boom 23 where it extends forwards on the outer side of the rechargeable battery 29 as indicated by the shaded area 40. The microphone boom 23 has a height $H_m$ of about 6 mm and a width $W_m$ of about 6 mm. The microphone boom 23 is mechanically connected to an upper portion of the battery compartment 50 in order to have the connection located further outwards. The microphone boom 23 extends forwards and downwards from the main body 22 by a boom length $L_m$ (see FIG. 3*a*) of about 34 mm.

Similarly as in the monaural wireless headset 20 of FIGS. 2-4, and although not shown in FIG. 5, a circuit board 26 is arranged within the microphone boom 23 and extends through a length portion of the microphone boom 23; a microphone 27 is arranged near the mouth end of the circuit board 26 within the microphone boom 23; a wireless transceiver 28 is arranged at the circuit board 26 along a major portion thereof; and an outwards facing wall 34 of the microphone boom 23 has a microphone inlet 35 near its mouth end that acoustically connects the environment with a sound inlet of the microphone 27 such that a voice signal from the user may reach the microphone 27 when the monaural wireless headset 20 is worn in the wearing position.

Figure 6:
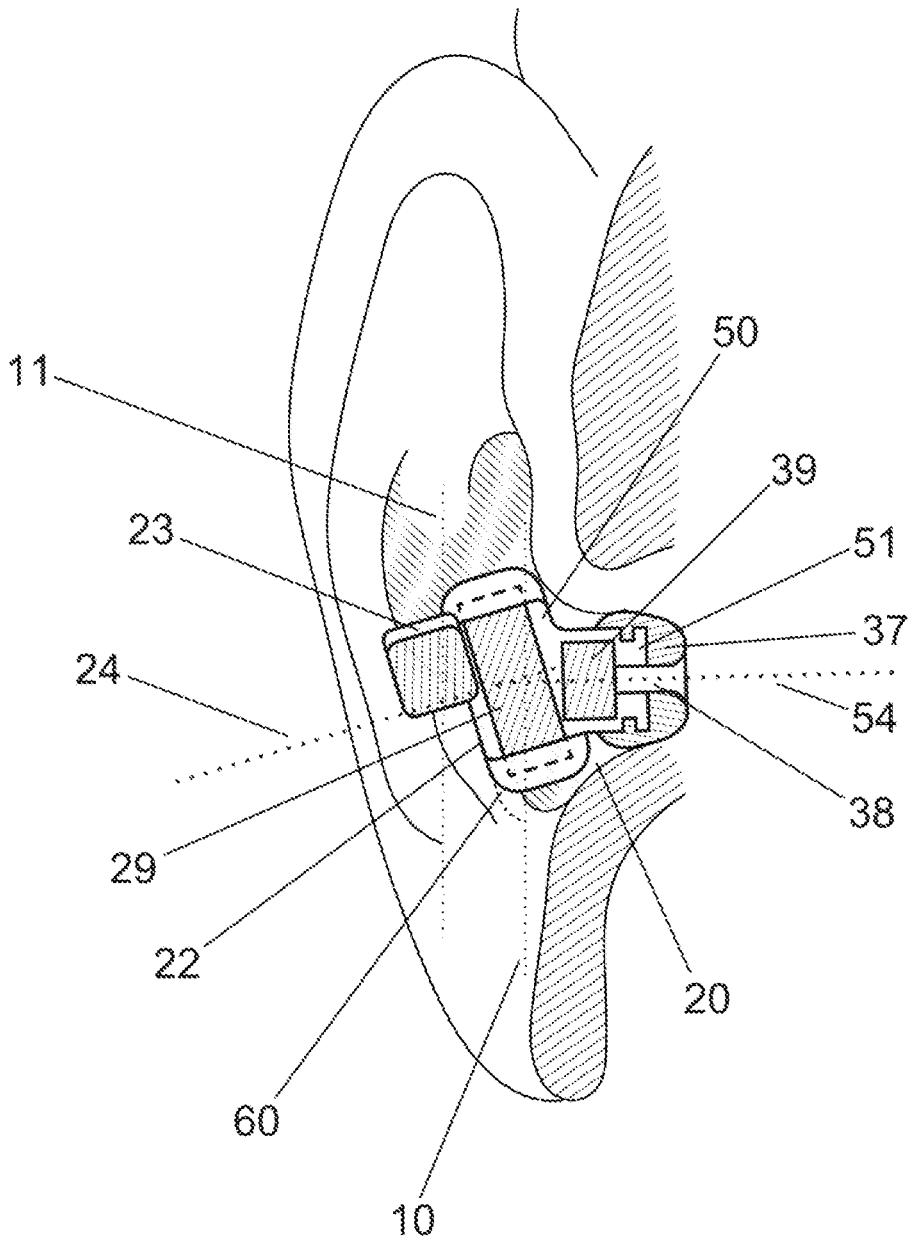
FIG. 6 shows a wearing position of the monaural wireless headset of FIG. 5.
Figure 7:
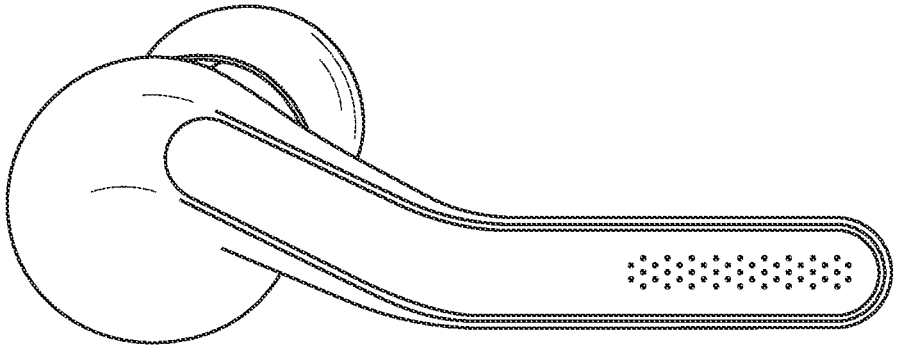
FIG. 7 is a front and upper perspective view of the headset shown the microphone boom having a bend/offset.
Figure 8:
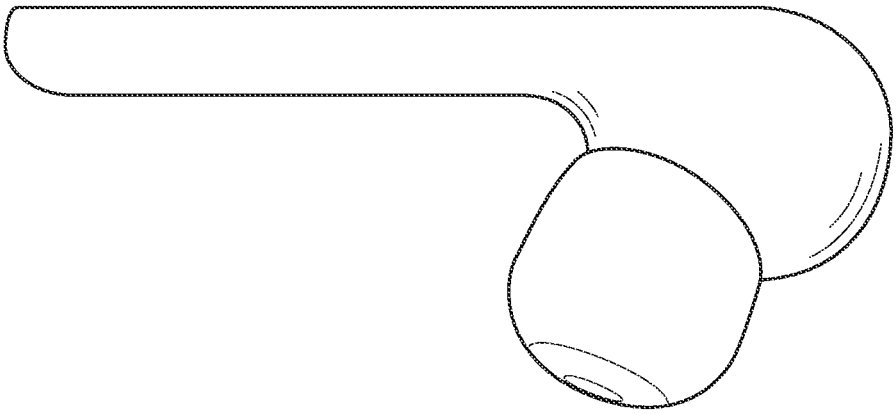
FIG. 8 is a rear bottom perspective view of the headset in FIG. 7.

FIG. 6 shows a frontal section of the pinna 1 of FIG. 1 with the monaural wireless headset 20 of FIG. 5 arranged in its intended wearing position. The section plane is the same as in FIG. 1 and in FIG. 5. Since the shape of the pinna 1 is individual for each user, the actual wearing position may deviate from the shown intended wearing position. The monaural wireless headset 20 is shown with the earbud 37 inserted into the ear canal 3 such that the earbud channel 38 leads sound output from the speaker driver 39 directly into the ear canal 3. The speaker axis 54 is oriented approximately horizontally with a slight upwards inclination in the inwards direction and is thus substantially coaxially aligned with the ear canal 3.

A support surface 60 of the main body 22 abuts an inwardly inclined surface portion 12 of the antitragus 6 when the monaural wireless headset 20 is in the wearing position. Thus, a portion of the main body 22 laterally overlaps the antitragus 6 on the inwards side thereof. The support surface 60 extends mainly across lower and rear portions of the axially outer surface of the battery compartment 50. The exact position and extension of the support surface 60 for a particular user depends on the actual shape of the user's pinna 1 and on the user's choice of downwards angle β of the microphone boom 23.

The general design of the monaural wireless headset 20, the dimensions of the housing 21 as well as the shown arrangement of the rechargeable battery 29 and the speaker driver 39 within the main body 22 allows most adult users to arrange the monaural wireless headset 20 such in their ear 1 that the speaker driver 39 and a major portion of the rechargeable battery 29 reside on the inside of the crest 7 of the antitragus 6. Since the rechargeable battery 29 and the speaker driver 39 are relatively heavy components of the monaural wireless headset 20, the shown headset configuration and wearing position provide for an improved balance of the housing 21 such that for most adult users, the earbud 37 and the support surface 60 will suffice to securely hold the monaural wireless headset 20 in place during use. Furthermore, the resilient earbud 37 as well as the smooth support surface 60 make the monaural wireless headset 20 comfortable to wear. Preferably, a portion of the rechargeable battery 29 laterally overlaps the antitragus 6 on the inwards side thereof.

In some embodiments, the microphone boom 23 extends linearly forwards and downwards towards the user's mouth when the monaural wireless headset 20 is in the wearing position—similarly to the microphone boom 23 shown in FIG. 2. However, compared with the monaural wireless headset 20 of FIGS. 2 through 4, the monaural wireless headset 20 of FIGS. 5 and 6 has the mechanical connection between the microphone boom 23 and the main body 22 located further inwards. For some users, this may cause the microphone boom 23 to touch the tragus (not shown), which may reduce the wearing comfort. In order to avoid touching the tragus, the microphone boom 23 may preferably have one or more bends along its length allowing it to circumvent the tragus. In some embodiments, the microphone boom 23 may have an outwards bend near the main body 22, corresponding to the angle α (see FIG. 3*b*) being larger than 90°, and an inwards bend further forwards to allow the foremost portion of the microphone boom 23 to be approximately aligned with the user's cheek. In some embodiments, the microphone boom 23 may have an upwards bend about 15 mm from the main body 22 such that the microphone boom 23 may escape the pinna 1 through the tragical notch (not shown) at a relatively steep downwards angle β (see FIG. 2) and continue outside the pinna 1 towards the user's mouth at a less steep angle β.

Each of the monaural wireless headsets 20 described above may preferably function and be operated like a conventional monaural wireless headset, and unless otherwise stated, the following description may apply to each of these as well as to further embodiments constituting variations of each of the monaural wireless headsets 20 described above.

The microphone 27 is preferably adapted to receive a voice signal from the user and provide a microphone signal to the wireless transceiver 28 in dependence on the voice signal when the monaural wireless headset 20 is in the wearing position. The wireless transceiver 28 is preferably adapted to transmit a wireless output signal, e.g. to a mobile phone (not shown) through a Bluetooth connection, in dependence on the microphone signal. The wireless transceiver 28 is further preferably adapted to receive a wireless input signal, e.g. from a mobile phone (not shown) through a Bluetooth connection, and provide an audio output signal to the speaker driver 39 in dependence on the wireless input signal. The speaker driver 39 is preferably arranged and adapted to transmit a sound signal into the ear 1 of the user in dependence on the audio output signal when the monaural wireless headset 20 is in the wearing position, and the rechargeable battery 29 is preferably adapted to provide electric power to headset components, such as e.g. the microphone 27, the wireless transceiver 28 and/or the speaker driver 39.

The monaural wireless headset 20 may preferably further comprise one or more control elements for controlling functions of the headset 20, such as e.g. a power switch for switching the headset 20 on and off, an answer control for accepting incoming phone calls, a reject control for rejecting incoming phone calls, a volume control for changing the sound output level of the speaker driver 39, a mute control for muting the microphone 27, a charging connector and a charging circuit for charging the rechargeable battery 29 and/or one or more status indicators for indicating a device status, such as e.g. a power status, a call status and/or a wireless-connection status of the headset 20.

The wireless transceiver 28 may be adapted to connect to an external device, such as e.g. a mobile phone, a personal computer, a headset base station, a media player or the like through a wireless connection, which may e.g. be a Bluetooth connection, a DECT connection, a Wi-Fi connection or any other suitable wireless connection, and the wireless transceiver 28 preferably comprises a corresponding antenna and corresponding encoders and decoders for the wireless signals.

The monaural wireless headset 20 may preferably comprise one or more further microphones 27, e.g. comprised by the microphone boom 23 and/or the main body 22, and each being adapted to provide a further microphone signal to the wireless transceiver 28 in dependence on the voice signal and/or an acoustic signal from the environment when the monaural wireless headset 20 is in the wearing position, and the wireless transceiver 28 may further be adapted to transmit the wireless output signal in dependence on the one or more further microphone signals. The wireless transceiver 28 may for instance apply any known signal processing to the microphone signals, such as e.g. beamforming, frequency shaping, noise reduction, echo cancelling or the like. The monaural wireless headset 20 may for instance comprise a second microphone (not shown) with a sound inlet acoustically connected to a microphone inlet located on the microphone boom 23 about 11 mm further rearwards along the boom axis 25, and the wireless transceiver 28 may combine the microphone signals from the first microphone 27 and the second microphone into a directional microphone signal that emphasizes the user's voice over environment noise in the transmitted wireless output signal. The wireless transceiver 28 may alternatively or additionally apply any known signal processing to the received wireless input signal and provide the audio output signal to the speaker driver 39 and/or the wireless output signal in dependence on the processed wireless input signal and/or one or more microphone signals.

The monaural wireless headset 20 provides an improved compromise between the partly contradictory requirements that are typically applied to such headsets. For instance, achieving a satisfying operating range of a wireless connection to a mobile phone generally requires that the antenna used to wirelessly connect to the mobile phone be located outside the ear canal 3 and preferably also outside the pinna 1. Also, achieving a satisfying quality of the voice signal sent to the mobile phone generally requires that the microphone used to pick up the user's voice be located outside the pinna 1 as well and preferably having an increased sensitivity towards the user's mouth. These two requirements are preferably addressed by arranging the wireless transceiver 28 and the microphone 27 in a portion of the headset housing 21 that is outside the pinna 1, in particular in a relatively slim microphone boom 23 extending from the main body 22 towards the user's mouth, which allows for a shorter main body 22 and an improved weight distribution in the headset 20.

In the monaural wireless headset 20, the rechargeable battery 29 is arranged within the main body 22, and at least a portion of the main body 22 is adapted to extend into the concha 9, preferably such that the speaker driver 39 and a portion of the rechargeable battery 29 resides on the inwards side of the crest 7 of the antitragus 6 when the monaural wireless headset 20 is in the wearing position. This allows for an improved weight distribution in the headsets 20. In embodiments similar to the monaural wireless headset 20 of FIGS. 2-4, the speaker driver 39 preferably has a width $W_d$ of less than 5 mm or more preferably less than 4 mm and is preferably arranged such that its inwards facing surface is about flush with the inwards facing surface of the housing 21. In some embodiments, the inwards facing surface of the speaker driver 39 may be arranged up to about 0.5 mm or up to about 1 mm further inwards than the inwards facing surface of the housing 21, i.e. slightly protruding from the housing 21. In some embodiments, the inwards facing surface of the speaker driver 39 may be arranged up to about 1 mm or up to about 2 mm further outwards than the inwards facing surface of the housing 21, i.e. slightly recessed with respect to the housing 21. In embodiments similar to the monaural wireless headset 20 of FIGS. 5-6, the inwards facing surface of the speaker driver 39 may preferably be arranged between about 0 mm and about 3 mm further outwards than the inwards facing surface of the housing 21, i.e. slightly recessed. In any embodiment, the speaker driver 39 may preferably comprise a preferably rigid protective cover, such as a mesh, a grill or a plate with one or more holes, constituting a portion of the inwards facing surface of the speaker driver 39 and allowing sound to pass between the sound outlet of the speaker driver 39 and the environment.

The portion of the main body 22 that comprises the rechargeable battery 29 preferably has an at least approximately circular cross section and a smooth surface, such that it does not cause discomfort to the user during wearing or during rotating of the main body 22 about the battery axis 24. Thus, the user may adjust the downwards angle β of the microphone boom 23 by rotating the monaural wireless headset 20 about the battery axis 24 while the monaural wireless headset 20 is in the wearing position without feeling any discomfort. This allows for the main body 22 and the microphone boom 23 to be permanently mechanically connected in a fixed position with respect to each other and thus allows for a mechanically simple and robust structure of the housing 21. Furthermore, in each of the embodiments disclosed, the main body 22 has a size that allows arranging a relatively large rechargeable battery 29 therein, such that an acceptable operation time can be achieved. In embodiments similar to the monaural wireless headset 20 of FIGS. 2-4, the cylindrical portion of the main body 22 preferably has a diameter or height $H_b$ in the range between 12 mm and 18 mm or even more preferably in the range between 14 mm and 16 mm. In embodiments similar to the monaural wireless headset 20 of FIGS. 5-6, the circular portion of the main body 22 preferably has a diameter or height $H_b$ in the range between 14 mm and 20 mm or even more preferably in the range between 16 mm and 18 mm.

An improved weight balance may be achieved by arranging the rechargeable battery 29 such that the axially inner end or surface area thereof is less than 5 mm or less than 4 mm from the axially inner end or surface area of the speaker driver 39. This allows not only the entire speaker driver 39 but also a portion of the rechargeable battery 29 to reside on the inside of the antitragus crest 7, thereby providing an improved balance of the monaural wireless headset 20.

Cylindrically wound batteries, such as the rechargeable battery 29 of the monaural wireless headset 20 of FIGS. 2-4, are typically manufactured with axially opposite fin-shaped electrodes 31, 32 extending in one and the same plane comprising the battery axis. Thus, it may be required to bend the inner electrode 32 during or after manufacturing in order to have it extend mainly in a plane perpendicular to the battery axis 24 as shown in FIG. 3*c*. In order to avoid extra manufacturing cost, other embodiments may comprise a rechargeable battery 29 with both fin-shaped electrodes 31, 32 extending in one and the same plane, preferably in the device-median plane 33. This may require the cylindrical portion of the rechargeable battery 29 to be arranged further away from the speaker driver 39 than shown in FIG. 3*c*. Alternatively, the battery axis 24 may be inclined with respect to the speaker axis 54, such as e.g. shown in FIG. 5, which may leave enough space for an inner electrode 32 extending in the device-median plane 33. Similarly, the rechargeable battery 29 of the monaural wireless headset 20 shown in FIGS. 5-6 may alternatively comprise a cylindrically wound battery with both fin-shaped electrodes 31, 32 extending in one and the same plane, preferably parallel to the boom axis 25, and the circuit board 26 may be arranged in parallel with the outer electrode 32 where they overlap, e.g. as shown in FIG. 2.

In other embodiments, the shapes and/or the dimensions of the monaural wireless headset 20 or of the housing 21 may deviate from the ones disclosed above. For instance, the total length L of the microphone boom 23 may be in the range between 40 mm and 80 mm, preferably in the range between 50 mm and 70 mm; the boom length $L_m$ may be in the range between 20 mm and 60 mm, preferably in the range between 30 mm and 50 mm; the height $H_m$ of the microphone boom 23 may be in the range between 3 mm and 9 mm, preferably in the range between 5 mm and 7 mm, and may vary along the length of the microphone boom 23; the width $W_m$ of the microphone boom 23 may be in the range between 3 mm and 11 mm, preferably in the range between 5 mm and 9 mm, and may vary along the length of the microphone boom 23; the outwards offset $W_o$ of the microphone boom 23 may be in the range between 8 mm and 16 mm, preferably in the range between 10 mm and 12 mm; the width $W_c$ of the circuit board 26 may be in the range between 2 mm and 5 mm where it extends across the axially outer end of the rechargeable battery 29 and may be in the range between 2 mm and 10 mm, preferably in the range between 5 mm and 9 mm, in other length sections; the width $W_r$ of the cylindrical section of the rechargeable battery 29 may be in the range between 8 mm and 16 mm, preferably in the range between 10 mm and 12 mm; the width $W_d$ of the speaker driver 39 may be in the range between 2 mm and 5 mm; the width $W_b$ along the battery axis 24 of the battery compartment 50 may be in the range between 4 mm and 12 mm, preferably in the range between 6 mm and 10 mm; the height $H_e$ of the speaker compartment 51 may be in the range between 4 mm and 12 mm, preferably in the range between 6 mm and 10 mm; the width $W_e$ along the speaker axis 54 of the speaker compartment 51 may be in the range between 4 mm and 12 mm, preferably in the range between 6 mm and 10 mm; the angle $\alpha$ may be in the range between 80° and 90°; and the angle $\gamma$ may be in the range between 15° and 25°. Furthermore, each of the headsets 20, and in particular the headset 20 of FIGS. 5-6 may be manufactured in a mirrored version to fit the left-hand ear 1 of a user. Also, the microphone boom 23 may be straight, curved and/or provided with one or more bends along its length.

In any embodiment, the monaural wireless headset 20, and in particular the wireless transceiver 28, preferably comprises one or more electronic circuits, such as e.g. analog circuits, digital circuits, microprocessors, signal processors or the like, adapted to perform the described operations as is already known for similar devices of the prior art. Such electronic circuits are preferably implemented as digital circuits operating on digital signals, but any portions hereof may be implemented as analog circuits operating on analog signals. Where necessary, any of the electronic circuits may comprise analog-to-digital and/or digital-to-analog converters. Functional blocks of digital circuits may be implemented in hardware, firmware or software, or any combination hereof. Digital circuits may perform the functions of multiple functional blocks in parallel and/or in interleaved sequence, and functional blocks may distributed in any suitable way among multiple hardware units, such as e.g. signal processors, microcontrollers and other integrated circuits.

The detailed description given herein and the specific examples indicating preferred embodiments of the invention are intended to enable a person skilled in the art to practice the invention and should thus be seen mainly as an illustration of the invention. The person skilled in the art will be able to readily contemplate further applications of the present invention as well as advantageous changes and modifications from this description without deviating from the scope of the invention. The mere mentioning of such changes or modifications herein is meant to be non-limiting for the scope of the invention.

The invention is not limited to the embodiments disclosed herein, and the invention may be embodied in other ways within the subject-matter defined in the following claims. As an example, features of the described embodiments may be combined arbitrarily, e.g. in order to adapt the devices according to the invention to specific requirements or uses.

Reference numerals and literal identifiers that appear in brackets in the claims are intended to be non-limiting for their scope.

The invention claimed is:

1. A monaural wireless headset comprising a housing with a main body and a microphone boom, a microphone, a wireless transceiver, a speaker driver and a battery, the monaural wireless headset being adapted to be arranged at an ear of a user in a wearing position wherein at least a portion of the main body resides on the inwards side of the crest of the ear's antitragus and wherein the microphone boom at least partly extends outside the ear's pinna towards the user's mouth, the microphone being comprised by the microphone boom and being adapted to receive a voice signal from the user and provide a microphone signal to the wireless transceiver in dependence on the voice signal when the monaural wireless headset is in the wearing position, the wireless transceiver being adapted to transmit a wireless output signal in dependence on the microphone signal, the wireless transceiver further being adapted to receive a wireless input signal and provide an audio output signal to the speaker driver in dependence on the wireless input signal, the speaker driver being arranged and adapted to transmit a sound signal into the ear in dependence on the audio output signal when the monaural wireless headset is in the wearing position, and the battery being adapted to provide electric power to the wireless transceiver and the speaker driver, wherein the speaker driver and the battery are arranged in the main body in such a way that the speaker driver and at least a first portion of the battery reside on the inwards side of the crest of the antitragus when the monaural wireless headset is in the wearing position.

2. A monaural wireless headset according to claim 1 and further being adapted to be worn without wearing means extending outside the ear's concha.

3. A monaural wireless headset according to claim 1, wherein the speaker driver and the battery are arranged adjacent to each other with a minimum distance to each other of less than 2 mm.

4. A monaural wireless headset according to claim 1, wherein the battery-comprises a cylindrically wound battery having a cylindrical section.

5. A monaural wireless headset according to claim 4, wherein the battery is rechargeable and has a first electrode mainly extending in a first plane parallel to the cylinder axis of the cylindrical section of the rechargeable battery and wherein the microphone boom extends mainly in parallel to the first plane.

6. A monaural wireless headset according to claim 5, wherein the wireless transceiver is at least partly arranged in the microphone boom and wherein the wireless transceiver and the first electrode overlap each other in a direction orthogonal to the first plane.

7. A monaural wireless headset according to claim 4, wherein the speaker driver has a cylindrical section with a cylinder axis equal to the cylinder axis of the cylindrical section of the battery.

8. A monaural wireless headset according to claim 4, wherein the speaker driver has a cylindrical section with a cylinder axis that is inclined with respect to the cylinder axis of the cylindrical section of the battery.

9. A monaural wireless headset according to claim 1, wherein the main body has a support surface adapted to abut a portion of the crest of the antitragus when the monaural wireless headset is in the wearing position.

10. A monaural wireless headset according to claim 1, wherein the main body has a support surface adapted to abut an inwardly inclined surface of the antitragus when the monaural wireless headset is in the wearing position.

11. A monaural wireless headset according to claim 1, wherein the axially inner end or surface area of the rechargeable battery is less than 5 mm from the axially inner end or surface area of the speaker driver.

12. A monaural wireless headset according to claim 1, wherein the first portion of the battery comprises at least 25% of the volume of the battery.

13. A monaural wireless headset according to claim 12, wherein the first portion of the battery comprises at least 50% of the volume of the rechargeable battery.

14. A monaural wireless headset comprising:

a housing having a main body, a microphone boom, a microphone, a wireless transceiver, a speaker driver and a battery, the monaural wireless headset being adapted to be fitted in an ear of a user in a wearing position wherein at least a portion of the main body resides on the inwards side of the crest of the user's ear antitragus and wherein the microphone boom at least partly extends outside the user's ear pinna towards the user's mouth, the microphone and microphone boom being adapted to receive a voice signal from the user and provide a microphone signal to the wireless transceiver in response to a voice signal when the monaural wireless headset is in the wearing position, the wireless transceiver being adapted to transmit a wireless output signal in dependence on the microphone signal, the wireless transceiver further being adapted to receive a wireless input signal and provide an audio output signal to the speaker driver in response to a wireless input signal, the speaker driver being arranged and adapted to transmit a sound signal into the ear in response to an audio output signal when the monaural wireless headset is in the wearing position, and the battery being adapted to provide electric power to the wireless transceiver and the speaker driver, wherein the headset has a longitudinal center of gravity which is located on the at least so that the headset tends to have a turning moment toward inside the user's ear so that it is less likely to fall out; and wherein the antitragus crests that the speaker driver and the battery are located in the main body in such a way that the speaker driver and at least a first portion of the battery reside on the inwards side of the crest of the antitragus when the monaural wireless headset is in the wearing position.

15. The headset of claim 14 wherein the headset has a longitudinal center of gravity and wherein the user's antitragus crest defines a vertical plane, and wherein the center of gravity of said headset is within a plane.

16. The headset of claim 14 wherein the headset has a longitudinal center of gravity and wherein the user's antitragus crest defines a vertical plane, one side of which is facing the user's ear, and wherein the center of gravity of said headset is on the ear side of the plane.

17. The headset of claim 14 wherein the headset has a longitudinal center of gravity and wherein the center of gravity of the headset is located within the main body.

18. The headset of claim 14 wherein the headset has a longitudinal center of gravity and wherein the center of gravity of the headset is located longitudinally generally on the main body toward the user's mouth.

19. The headset of claim 14 wherein the headset has a longitudinal center of gravity and wherein at least 50% of the mass of the headset is located laterally on the inside of the antitragus crest.

20. The headset of claim 14 wherein the headset has a longitudinal center of gravity and wherein at least 50% of the mass of the headset is located with 5 mm of the antitragus crest.

* * * * *